US008261857B2

(12) United States Patent
Able et al.

(10) Patent No.: US 8,261,857 B2
(45) Date of Patent: Sep. 11, 2012

(54) CORE BARREL SONIC LATCH MECHANISM AND METHODS OF SONIC DRILLING USING THE SAME

(75) Inventors: Robert E. Able, Bozeman, MT (US); Thomas J. Oothoudt, Little Falls, MN (US)

(73) Assignee: Longyear TM, Inc., South Jordan, UT (US)

( * ) Notice: Subject to any disclaimer, the term of this patent is extended or adjusted under 35 U.S.C. 154(b) by 410 days.

(21) Appl. No.: 12/346,147

(22) Filed: Dec. 30, 2008

(65) Prior Publication Data

US 2009/0283329 A1 Nov. 19, 2009

Related U.S. Application Data

(60) Provisional application No. 61/053,294, filed on May 15, 2008.

(51) Int. Cl.
*E21B 25/02* (2006.01)

(52) U.S. Cl. ..... 175/58; 175/236; 175/246

(58) Field of Classification Search ..... 175/58, 175/236, 246

See application file for complete search history.

(56) References Cited

U.S. PATENT DOCUMENTS

| | | | | | |
|---|---|---|---|---|---|
| 3,266,835 | A | * | 8/1966 | Hall et al. | 294/86.24 |
| 3,346,059 | A | * | 10/1967 | Svendsen | 175/246 |
| 4,466,497 | A | * | 8/1984 | Soinski et al. | 175/246 |
| 5,020,612 | A | | 6/1991 | Williams | |
| 5,267,620 | A | | 12/1993 | Lee | |
| 5,325,930 | A | | 7/1994 | Harrison | |
| 5,549,170 | A | * | 8/1996 | Barrow | 175/55 |
| 5,562,169 | A | * | 10/1996 | Barrow | 175/56 |
| 5,934,393 | A | | 8/1999 | Marshall | |
| 6,029,758 | A | | 2/2000 | Novacovicci et al. | |
| 6,089,335 | A | | 7/2000 | Able | |
| 6,371,205 | B1 | | 4/2002 | Langan et al. | |
| 6,425,449 | B1 | | 7/2002 | Marshall | |
| 6,564,885 | B2 | | 5/2003 | Attwater | |

FOREIGN PATENT DOCUMENTS

| | | | |
|---|---|---|---|
| JP | 2003-221824 | A | 8/2003 |
| JP | 2005-515322 | A | 5/2005 |
| KR | 10-1997-0062255 | A | 9/1997 |
| KR | 10-2003-0041837 | A | 5/2003 |
| WO | WO0114689 | | 3/2001 |

OTHER PUBLICATIONS

International Search Report and Written Opinion dated Nov. 26, 2009 as issued in International Application No. PCT/US2009/043982 filed May 14, 2009.

* cited by examiner

*Primary Examiner* — David Andrews
(74) *Attorney, Agent, or Firm* — Ballard Spahr LLP

(57) ABSTRACT

A head assembly includes a body, a spearhead operatively associated with the body and configured to translate axially relative to the body, and at least one latch operatively associated with the spearhead and the body. The latch is configured to move between an extended position and a retracted position relative to the body in response to axial translation of the spearhead relative to the body. In an extended position, the latch covers more than 25% of the circumference of the body adjacent the latches.

30 Claims, 8 Drawing Sheets

CORE BARREL SONIC LATCH MECHANISM AND METHODS OF SONIC DRILLING USING THE SAME

CROSS-REFERENCE TO RELATED APPLICATIONS

This application claims the benefit of U.S. Provisional Patent Application 61/053,294 filed May 15, 2008, which is hereby incorporated by reference in its entirety.

BACKGROUND OF THE INVENTION

1. The Field of the Invention

This application relates generally to drilling devices and methods. In particular, this application relates to latches for wireline drill assemblies for use in sonic drilling processes.

2. Background and Relevant Art

Often, drilling processes are used to retrieve a sample of a desired material from below the surface of the earth. In sonic drilling process, an open-faced core drill bit is attached to the bottom or leading edge of a core barrel. The core barrel is attached to a drill string, which is a series of threaded and coupled drill rods that have been connected together. The core barrel is vibrated and optionally rotated and pushed into the desired sub-surface formation to obtain a sample of the desired material (often called a core sample). Often, the core barrel is positioned within an outer casing. In some cases, the outer casing and the core barrel may be advanced simultaneously. The outer casing can be used to maintain an open borehole and can be utilized to install wells, instruments and for many other purposes.

In drilling processes using wireline systems, the core barrel and the casing are advanced together into the formation. The casing has a drill bit connected to a drill string and is advanced into the formation. However, the core barrel does not necessarily contain a drill bit and is removable from the drill string in a core barrel assembly, allowing the drill string to remain in the hole. The core barrel assembly includes at least the core barrel and a head for attaching to a wireline. In normal operations, the core barrel assembly is lowered into the drill string until the head reaches a portion of the casing that engages with a latch on the head to restrict the movement of the core barrel assembly with respect to the casing. Once latched, the core barrel assembly advances into the formation along with the casing, causing material to fill the core barrel. When the core sample is obtained, the core barrel assembly is retrieved separately from the casing using a wireline system, and the core sample is removed. The wireline system removes the time needed to trip the drill rods in and out of the borehole to obtain a core sample.

Wireline systems are not usually used in sonic drilling processes because vibrations created during sonic drilling can be very destructive to components of a core barrel assembly, particularly latches. Conventional latches are easily damaged and destroyed in a sonic drilling process, leading to inefficiencies in repairing broken equipment and in partial samples. Additionally, traditional latches in wireline core barrel assemblies are not designed to resist both upward and downward forces on the core barrel assembly. The subject matter claimed herein is not limited to embodiments that solve any disadvantages or that operate only in environments such as those described above. Rather, this background is only provided to illustrate one exemplary technology area where some embodiments described herein can be practiced.

BRIEF SUMMARY OF THE INVENTION

A head assembly includes a body, a spearhead operatively associated with the body and configured to translate axially relative to the body, and at least one latch operatively associated with the spearhead and the body. The latch is configured to move between an extended position and a retracted position relative to the body in response to axial translation of the spearhead relative to the body. In an extended position, the latch covers more than 25% of the circumference of the body adjacent the latches.

A drilling assembly can include an outer casing and a head assembly configured to be positioned within the outer casing. The head assembly includes a body, a spearhead operatively associated with the body and configured to translate axially relative to the body, and a plurality of latches operatively associated with the spearhead and the body. The latches are configured to move between an extended position and a retracted position relative to the body in response to axial translation of the spearhead relative to the body. In an extended position, the latch covers more than 25% of the circumference of the body adjacent the latches to secure the head assembly in place relative to the outer casing.

A drilling system can include an outer casing and a head assembly configured to be positioned within the outer casing. The head assembly includes a body, a spearhead operatively associated with the body and configured to translate axially relative to the body, and a plurality of latches operatively associated with the spearhead and the body. The latches are configured to move between an extended position and a retracted position relative to the body in response to axial translation of the spearhead relative to the body. In an extended position, the latch covers more than 25% of the circumference of the body adjacent the latches to secure the head assembly in place relative to the outer casing. The system can include a sonic drill head configured to transmit vibratory forces to the outer casing.

A method of drilling can include tripping a core barrel assembly into a casing, engaging a latching mechanism such that the core barrel assembly is secured to the casing axially, and drilling using a sonic drilling process.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Devices, assemblies, systems, and methods are provided herein that include a latch mechanism for securing an assembly at a down-hole location. In at least one example, a latch mechanism is part of a wireline system in general and can be part of a core barrel system in particular. The latch mechanism can be part of a head assembly that can be lowered into position relative to an outer casing. Once positioned, the latch mechanism can be deployed to secure the head assembly at the desired location.

The latch mechanism and/or other components of the core-barrel assembly can be configured to allow the latch mechanism to be secured in position relative to the outer casing in such a manner as to allow the core-barrel assembly to be part of a sonic drilling system in which a drill head transmits sonic forces through the casing and/or core barrel assembly. For example, when deployed the latches of the latch mechanism can contact 25% or more of the interior circumference of the outer casing. Further, the latches can include any number of engagement features that interact with one or more type of corresponding features in the outer casing to help lock the head assembly in place relative to the outer casing.

Such a configuration can reduce the possibility the core-barrel assembly and the latches in particular will become dislodged and/or damaged by the vibratory forces associated with some drilling are transmitted through the drill string. Accordingly, such a configuration can reduce the downtime associated with sonic applications by reducing the time required to trip an entire drill string from within an outer casing.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques. For example, while the description below focuses on core sample operations, the apparatus and associated methods could be equally applied in other drilling processes, such as in conventional borehole drilling, and may be used with any number or varieties of drilling systems, such as rotary drill systems, percussive drill systems, etc.

Further, while the Figs. show four latches in the latching mechanism, any number of latches may be used. Similarly, the precise configuration of components as illustrated may be modified or rearranged as desired by one of ordinary skill. Additionally, while the exemplary embodiments specifically discuss a wireline system, any retrieval system may be used, such as a drill string.

Figure 1A:
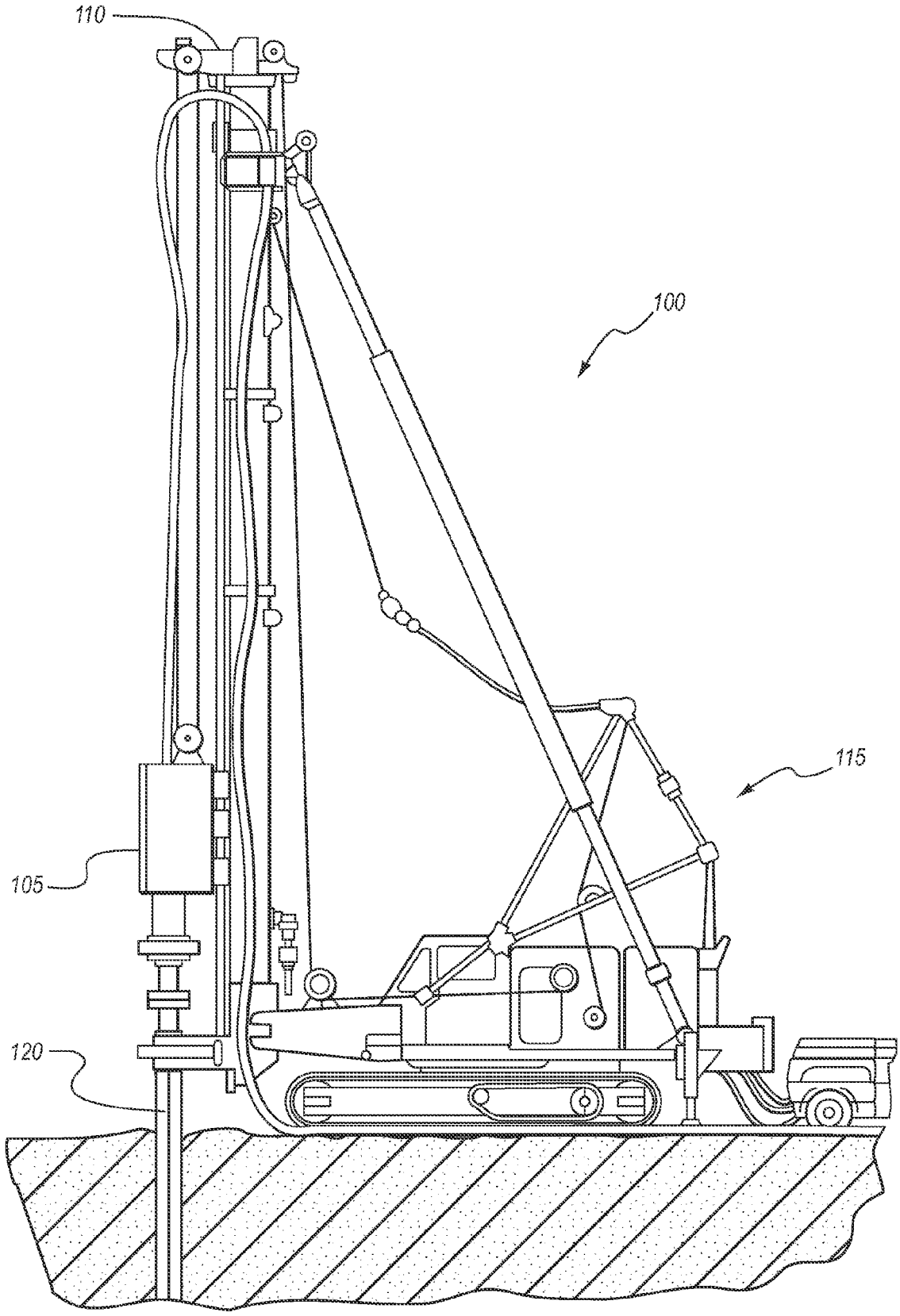
FIG. 1A illustrates a partial view of sonic drilling system according to one example.
Figure 1B:
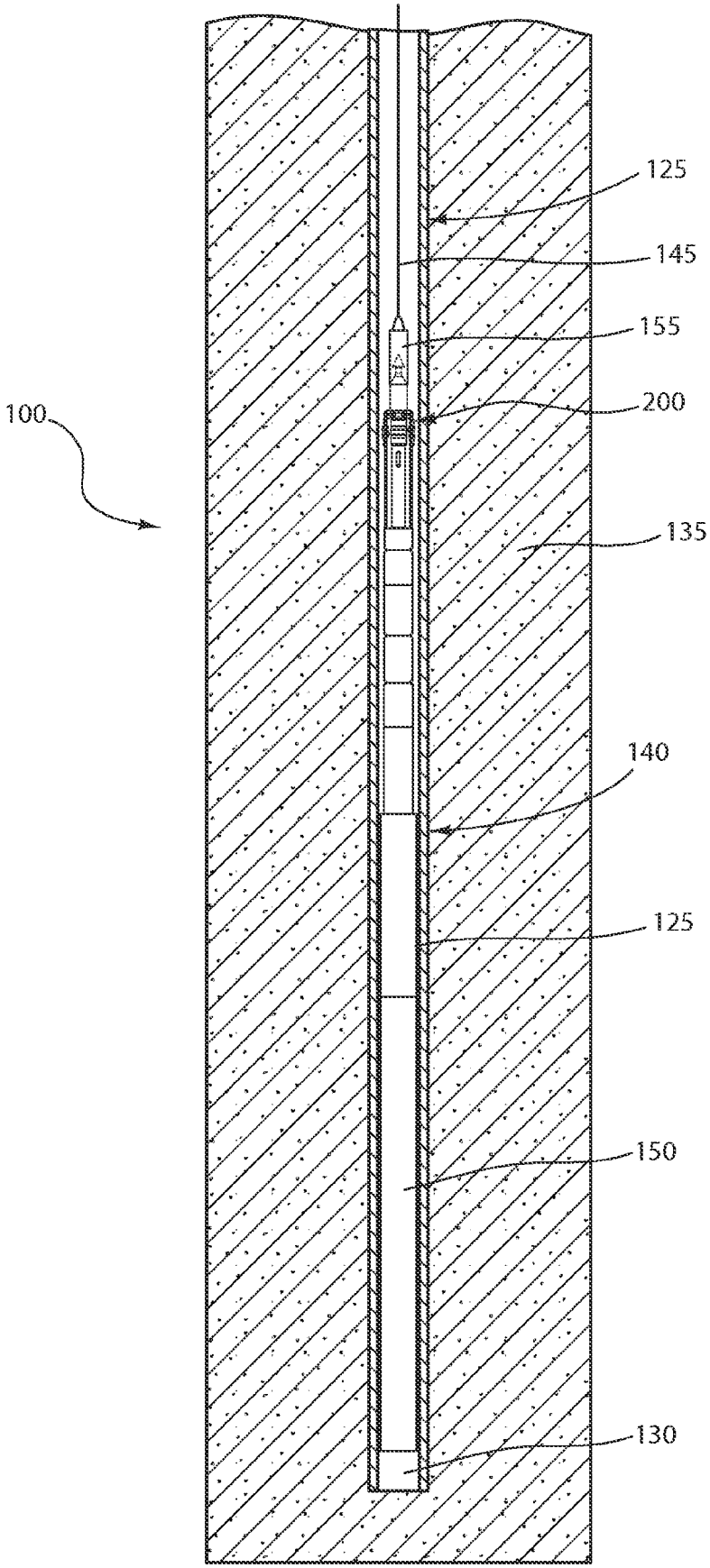
FIG. 1B illustrates another partial view of the sonic drilling system shown in FIG. 1A.

FIGS. 1A and 1B illustrate a drilling system 100 according to one example. In particular, FIG. 1A illustrates a surface portion of the drilling system 100 while FIG. 1B illustrates a subterranean portion of the drilling system 100. Accordingly, FIG. 1A illustrates a surface portion of the drilling system 100 that shows a drill head assembly 105. The drill head assembly 105 can be coupled to a mast 110 that in turn is coupled to a drill rig 115. The drill head assembly 105 is configured to have a drill rod 120 coupled thereto.

As illustrated in FIGS. 1A and 1B, the drill rod 120 can in turn couple with additional drill rods to form an outer casing 125. The outer casing 125 can be coupled to a drill bit 130 configured to interface with the material to be drilled, such as a formation 135. The drill head assembly 105 can be configured to rotate the outer casing 125. In particular, the rotational rate of the outer casing 125 can be varied as desired during the drilling process. Further, the drill head assembly 105 can be configured to translate relative to the mast 110 to apply an axial force to the outer casing 125 to urge the drill bit 130 into the formation 135 during a drilling process. The drill head assembly 105 can also generate oscillating forces that are transmitted to the drill rod 120. These forces are transmitted from the drill rod 120 through the outer casing 125 to the drill bit 130.

The drilling system 100 also includes a core-barrel assembly 140 positioned within the outer casing 125. The core-barrel assembly 140 can include a wireline 145, a down-hole component 150, an overshot assembly 155, and a core barrel head assembly (head assembly) 200. In the illustrated example, the down-hole component 150 can be coupled to the head assembly 200, which in turn can be removably coupled to the overshot assembly 155. When thus assembled, the wireline 145 can be used to lower the down-hole component 150, the overshot assembly 155, and the head assembly 200 into position within the outer casing 125.

The head assembly 200 includes a latch mechanism having latches that engage a relatively large percentage of the interior circumference of the outer casing 125. Such a configuration can help lock the head assembly 200 and consequently the down-hole component 150 in position at a desired location within the outer casing 125.

In particular, when the core-barrel assembly 140 is lowered to the desired location, the head assembly's 200 latch mechanism can be deployed to lock the head assembly 200 into position relative to the outer casing 125. The overshot assembly 155 can also be actuated to disengage the head assembly 200. Thereafter, the down-hole component 150 can rotate with the outer casing 125 due to the coupling of the down-hole component 150 to the head assembly 200 and of the head assembly 200 to the outer casing 125.

At some point it may be desirable to trip the down-hole component 150 to the surface, such as to retrieve a core sample. To retrieve the down-hole component 150, the wireline 145 can be used to lower the overshot assembly 155 into engagement with the head assembly 200. The head assembly 200 may then be disengaged from the drill outer casing 125 by drawing the latches into head assembly 200. Thereafter, the overshot assembly 155, the head assembly 200, and the down-hole component 150 can be tripped to the surface.

As will be discussed in more detail below, the head assembly 200 can have a robust configuration that reduces stresses associated with movement of the head assembly 300 relative to the drill string 150 by allowing a spearhead to pivot relative to a base portion. Further, the spearhead assembly 200 can return to a neutral position by interaction between a follower and a non-convex first follower surface on the spearhead assembly.

Figure 2A:
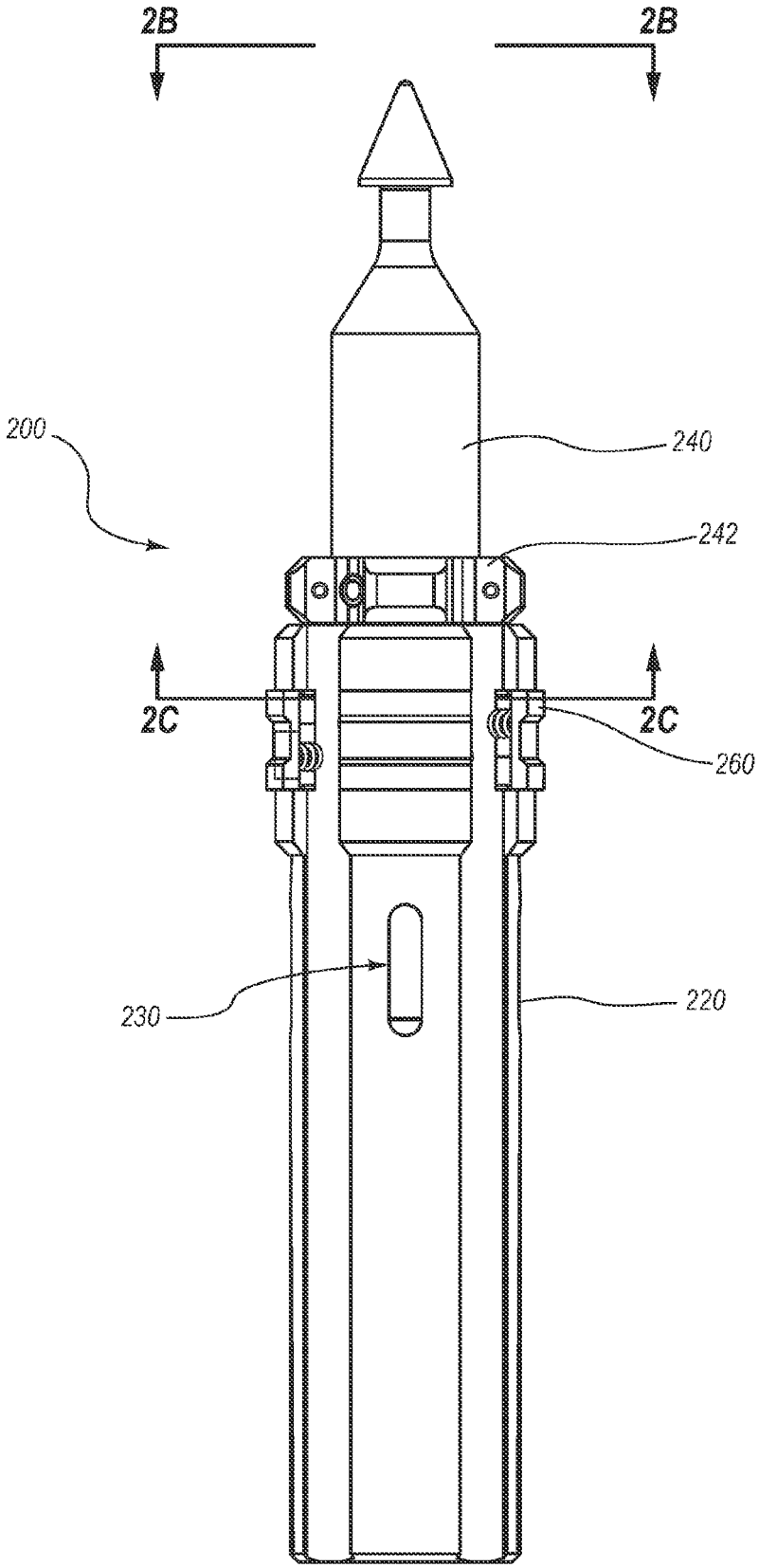
FIG. 2A illustrates a head assembly according to one example.
Figure 2B:
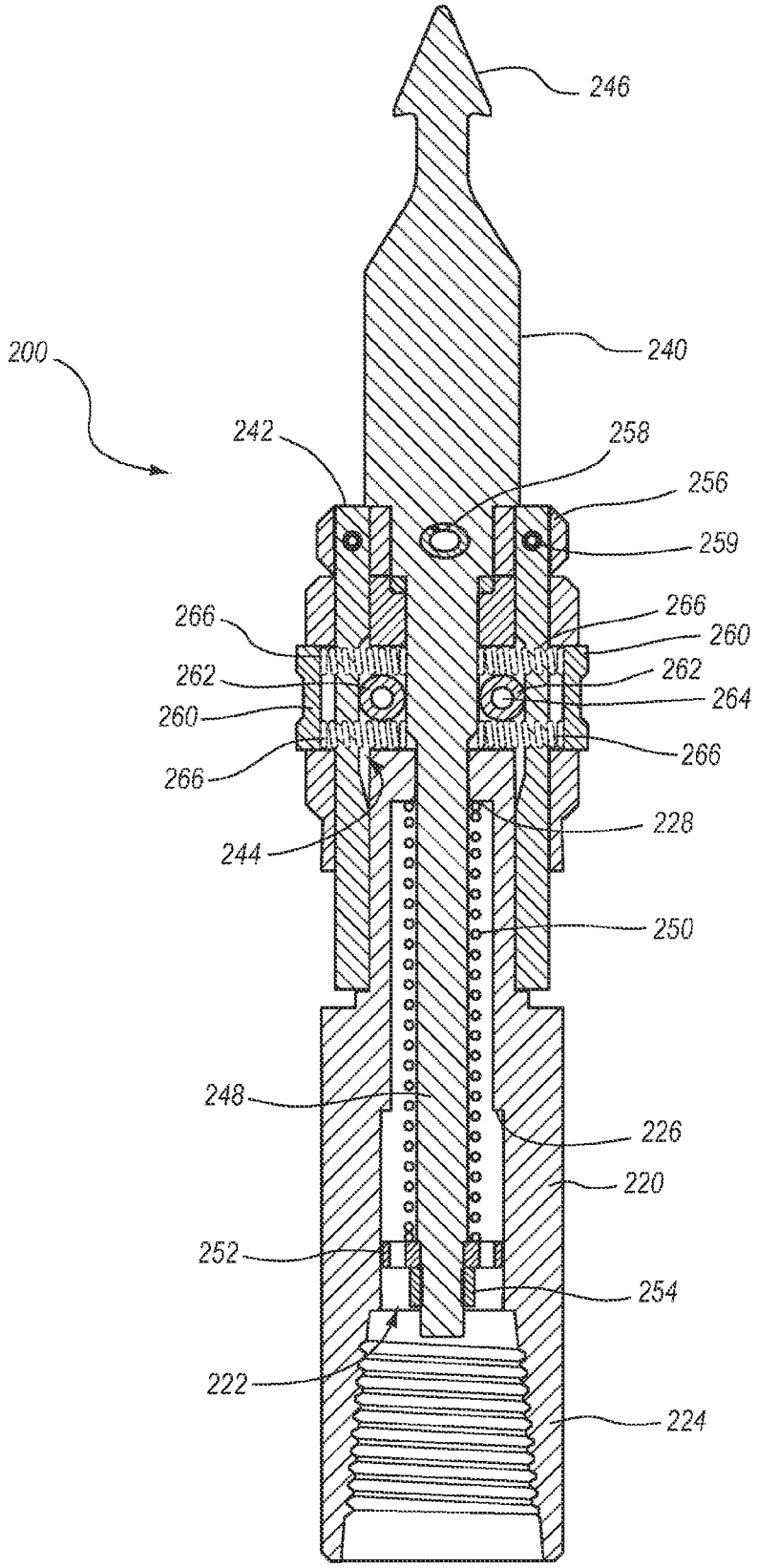
FIG. 2B illustrates a cross-sectional view of the head assembly of FIG. 2A taken along section 2B-2B.
Figure 3A:
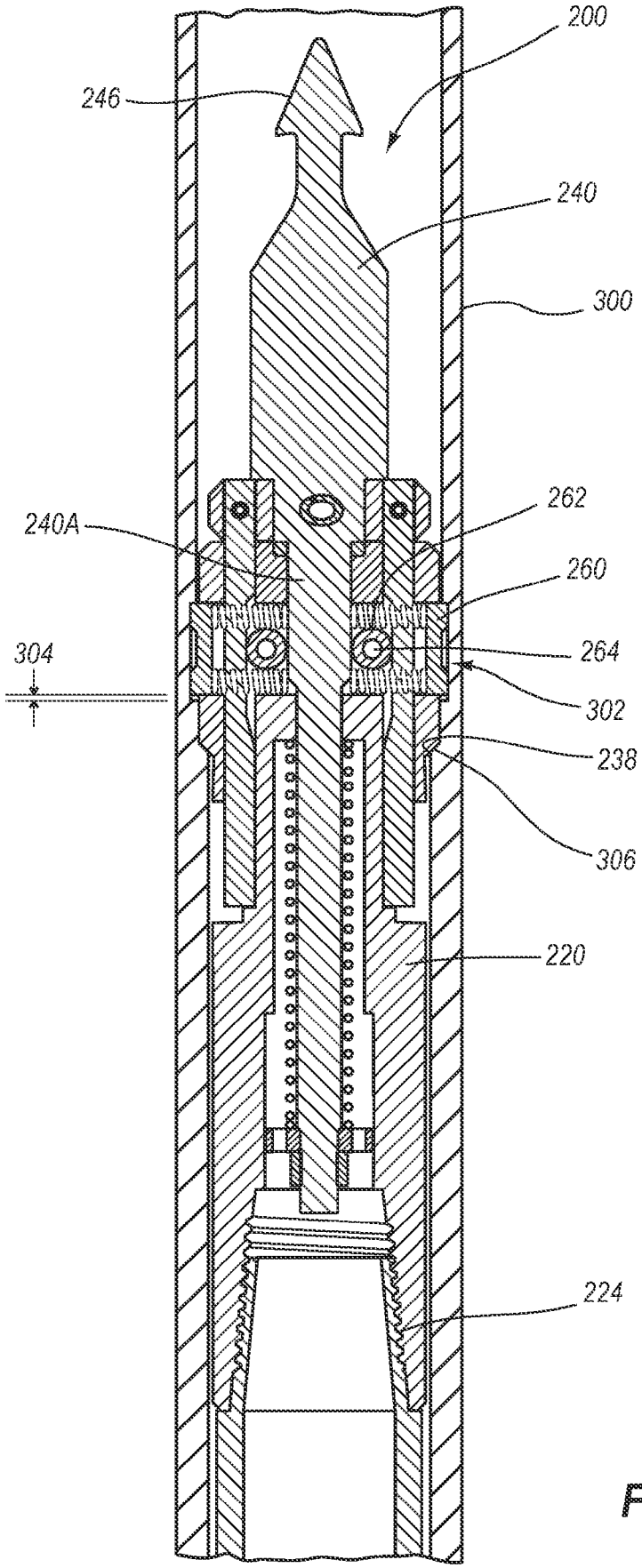
FIG. 3A illustrates a core-barrel assembly according to one example in which the latches of the head assembly are extended.
Figure 3B:
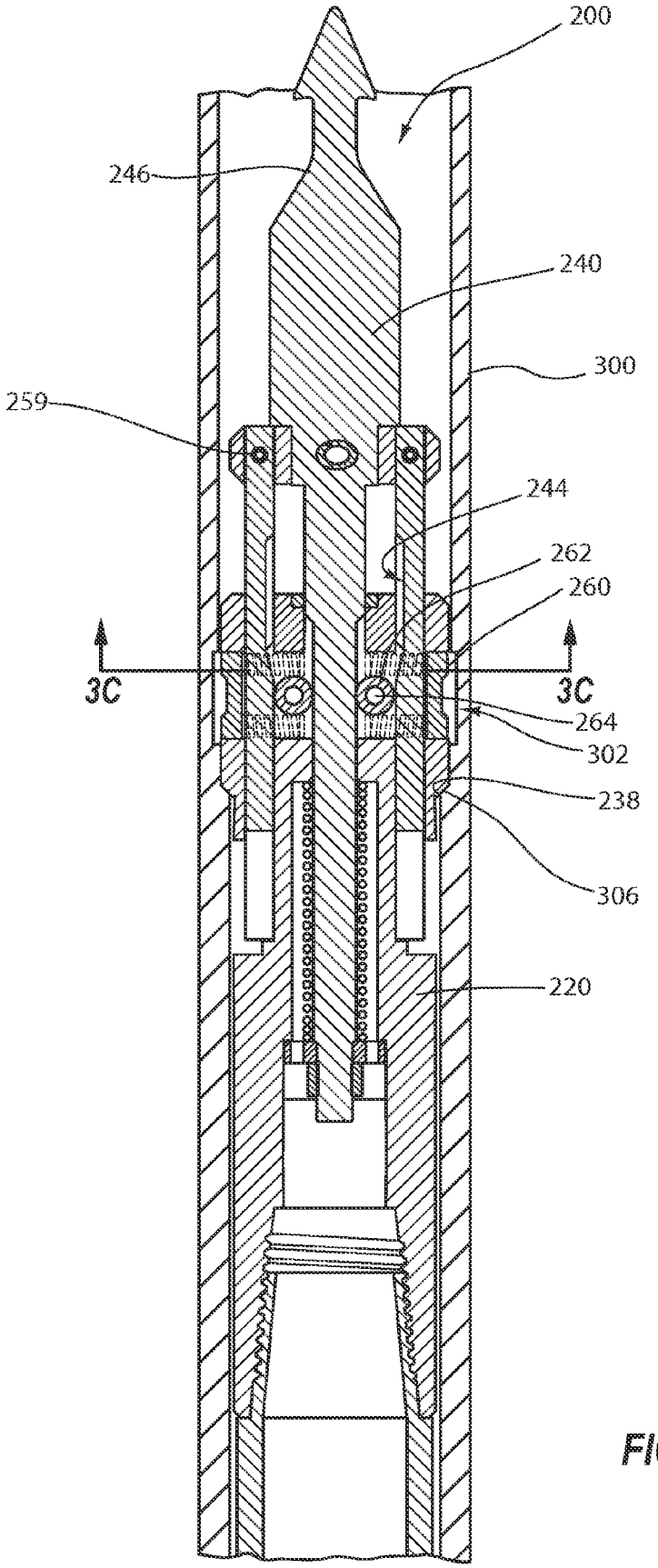
FIG. 3B illustrates the core barrel assembly of FIG. 3A in which the latches of the head assembly are retracted.

FIGS. 2A and 2B illustrate a more detailed view of the head assembly 200. In particular, FIG. 2A illustrates a plan view of the head assembly 200 while FIG. 2B illustrates a cross-sectional view taken along section 2B-2B in FIG. 2A. As illustrated in FIG. 2A, the head assembly 200 generally includes a body 220, a spearhead 240, and latches 260. As will be described in more detail below, axial translation of the spearhead 240 relative to the body 220 results in deployment and retraction of the latches 260. By way of introduction, a retracted position is shown in FIG. 3B while a deployed position is shown in FIG. 3A. Configurations of an exemplary body, spearhead, and latches will first be introduced, followed by the interaction of these components.

As introduced and as shown in FIG. 2B, the head assembly 200 includes the body 220, the spearhead 240, and the latches 260. Guide rails 242 are operatively associated with the spearhead 240. The guide rails 242 are configured to be operatively associated with the latches 260 by way of followers 262. In particular, as illustrated in FIG. 2B the guide rails 242 can include cammed surfaces 244. The followers 262 are configured to be biased into contact with the cammed surface 244. In the illustrated example, the latches 260 may be coupled to the followers 262 in such a manner that radial movement of the followers 262 as the followers 262 maintain contact with the cammed surfaces 244 results in corresponding radial translation of the followers 262. Radial translation of the followers 262 results in corresponding radial translation of the latches 260 allowing for deployment and retraction of the latches 260, as will be described in more detail below.

As shown in 2B, the body 220 includes a center channel 222 defined therein. The center channel 222 may be configured to provide a passageway for the spearhead 240. The body 220 may also include additional features in communication with the central channel 222 that constrain the translation of the spearhead 240 relative to the body 220. These features may include a connector 224, a stop ridge 226, and a spring stop 228. Center channel 222 may also provide a passageway for fluids and materials to pass through the head assembly 220 during operation. Additional ports 230 (FIG. 2A) may be provided in the body 220, as desired to further allow fluids and materials to pass through and around head assembly 200 to facilitate introduction of fluids, or to minimize fluid resistance while tripping the core barrel assembly 200 in and out of a borehole.

The connector 224 may be used to couple the head assembly 200 with other components, such as components of the wireline assembly (FIG. 1B), including a core barrel (not shown) and any intervening components necessary or desired during drilling operations. The connector 224 may be any type of connector or coupler, such as female threaded coupling, as shown in FIG. 2B, a pin connector, a welding joint, or any other connection type that may be used to connect head assembly 200 with additional components as desired by those skilled in the art.

Spearhead 240 may include a frustroconical point 246 for connecting the spearhead 240 to a wireline (not shown) for placing the core barrel assembly into a borehole, or for removing the core barrel assembly from a borehole as described above. In other examples, the head assembly 200 may include connectors other than the spearhead. Such connectors may be of any shape or design for connecting to a wireline system, such as a pin and clevis, eyelet, or any other connecting type. Similarly, frustroconical point 246 is not limited to wireline systems and may connect the head assembly 200 to a drill string in any known manner, or may connect head assembly 200 to any other kind of borehole insertion and removal system.

The spearhead 240 further includes a shaft 248 that extends away from the frustroconical point 246. Further, the shaft 248 can extend at least partially through a biasing member, such as a spring 250. In the illustrated example, a retaining washer 252 and a fastener 254 are coupled to a bit end of the shaft 248. Such a configuration can couple the spring 250 to the spearhead 240 by way of the retaining washer 252. The spring 250 may be held in place relative to the body 220 by engagement with the spring stop 228.

In the illustrated example, the spring 250 may compress between the spring stop 228 and retaining washer 252 as the spearhead 240 moves axially away from the connector 224. Accordingly, the spring 250 may be configured to bias the spearhead 240 toward the connector 224 to oppose axial movement of the spearhead 240 away from the connector 224. The stop ridge 226 may further limit the translation of the spearhead 240 away from connector 224. In particular, the stop ridge 226 may have a diameter smaller than the outer dimensions of the retaining washer 252 to prevent the spearhead 240 from being removed from the body 220.

In at least one example, a collar 256 can couple the guide rails 242 to the spearhead 240. In the illustrated example, a pin 258 can couple the collar 256 to the spearhead 240. While one configuration is illustrated, it will be appreciated that the spearhead 240 may be connected to collar 256 in any manner, including by threaded connection, welding, etc., or may be monolithic, being produced from a single piece of material. Similarly, the guide rail 242 may be connected to the collar 256 by pins 259, or may be connected to the collar 256 by any manner, including monolithic construction.

Figure 2C:
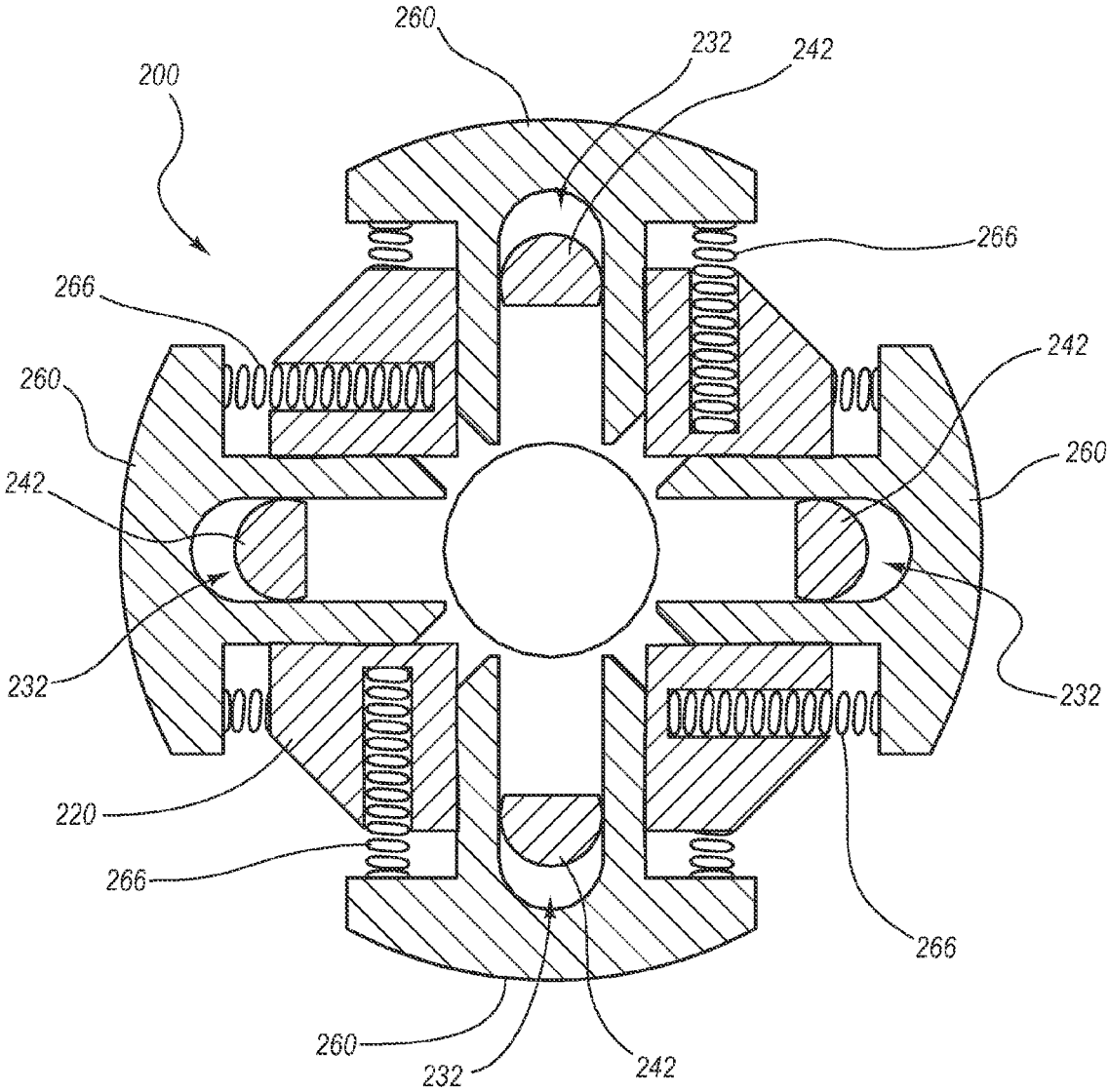
FIG. 2C illustrates a cross-sectional view of the head assembly of FIG. 2A taken along section 2C-2C.

As illustrated in FIG. 2C, the guide rails 242 may be located in channels 232 defined in body 220. The channels 232 reduce or prevent rotation of the guide rails 242 while allowing the axial movement of the guide rails 242 with respect to the body 220 as discussed above. As previously introduced and showing in FIG. 2B, the guide rails 242 can each include cammed surfaces 244, which cooperate with the followers 262 to move the latches 260 between an extended position and a retracted position.

The latches 260 may be positioned in recesses defined in the body 220. As shown in FIG. 2B, the followers 262 may be coupled to the latches 260 by follower pins 264, such that the followers 262 roll on the cammed surfaces 244 on the guide rails 242 as the spearhead 240 and guide rails 242 move axially with respect to body 220 as discussed above.

In the example illustrated in FIG. 2C, four latches 260 are located around the circumference of the body 220. In other examples a single latch may be used. In other examples, two, three, or five or more latches may be used. In each embodiment, latches 260 may cover a portion of the circumference of the body 220 sufficient to adequately withstand the forces and vibrations of a sonic drilling operation without shearing or destroying the latches 260. In some embodiments, at least about 25% of the circumference of the body 220 is covered by the latches 260, while in other embodiments about 50% or more of the circumference of the body 220 is covered by the latches 260, as is illustrated in FIG. 2C.

Referring again to FIG. 2B, at least one latch spring 266 is associated with each of the latches 260. In the illustrated example, two latch springs 266 are associated with each latch 260. The latch springs 266 bias latches 260 radially away from the body 220. Such a configuration therefore biases the latches 260 in an extended position. In the illustrated example, the latch springs 266 are positioned in spring channels defined in the body 220. The latches 260 are held in the body 220 by engagement with the followers 262 as the latch springs 266 urge the followers 262 into contact with the cammed surfaces 244.

FIG. 3A illustrates the latches 260 in an extended position within a casing 300, which may be similar to the outer casing 125 described above. The casing 300 may be a drill casing, a drill string, or any other drilling rod as is known to those skilled in the art. The casing 300 may include one or more surface feature 302, which cooperates with latches 260 to secure head assembly 200 to the casing 300. The casing 300 may also include a ridge 306, which cooperates with a lip 238 formed on the body 220 to locate the head assembly 200 at the desired position in the casing 300.

The surface feature 302 may be a cut formed in the inner surface of casing 300 as illustrated. Surface feature 302 may extend around the entire inner circumference of the casing 300, or may be individual features to cooperate with one or more of the latches 260. In some embodiments, the surface feature 302 may include a protrusion, a variable pattern, or any other design that functions to cooperate with the latches 260. Similarly, the latches 260 may be of various shapes and designs to cooperate with the surface features 302, or any configuration to operate as discussed herein.

FIG. 3B illustrates the latches 260 in a retracted position. In some embodiments, to engage latches 260 in an extended position, the core barrel assembly is lowered into the casing 300 using a wireline 145 (FIG. 1B), as described above. During lowering, the weight of the core barrel assembly, of which the head assembly 200 may be a part, pulls down on the body 220 such that spearhead 240 is drawn away from the body 220 as discussed above. The followers 262 roll out of engagement with the cammed surfaces 244 on the guide rails 242, forcing the latches 260 inwardly into the body 220. In a refracted position, the latches 260 are disengaged from the casing 300, limiting the drag and the time required to trip the core barrel assembly into a borehole.

Once the core barrel assembly reaches the desired depth, ridge 306 cooperates with lip 238 to prevent the core barrel assembly from lowering any further into the casing 300. As the weight of the core barrel assembly, including the head assembly 200, is transferred to the outer case 300 by way of the ridge 306; the spearhead 240 moves toward the connector 224 as the spring 250 and gravity apply the sufficient force to move the spearhead 240 toward the connector 224. As the spearhead 240 moves toward the connector 224, the guide rails 242 also move in the same direction, moving the cammed surface 244 to a position to allow the latches 260 to deploy. As the latches 260 deploy, the latches 260 engage the surface features 302. Each latch 260 may engage independently, as each latch 260 may have a dedicated latch spring or springs 266.

To remove the core barrel assembly, an axial force may be applied to frustroconical point 246, forcing the spearhead 240, and consequently the guide rails 242 away from the connector 224. As the guide rails 242 thus translate axially, the cammed surfaces 244 force the followers 262 and the latches 260 inward into a retracted position and out of engagement with the surface features 302. In a retracted position, the core barrel assembly may be tripped out of the borehole.

As shown in FIG. 3A, to minimize damage to latches 260, a vertical tolerance 304 between the latches 260 and the surface feature 302 may be minimized, preferably as small as possible. In some embodiments, the tolerance 304 may be less than about 0.015 inches. In other embodiments, the tolerance 304 may be about 0.05 inches or less. The minimized tolerance 304 can limit the inertia between a core barrel assembly, including the head assembly 200, and the casing 300 during drilling operations, particularly sonic drilling operations. Reducing inertia can reduce forces on latches 260 as well as any resulting damage.

Figure 3C:
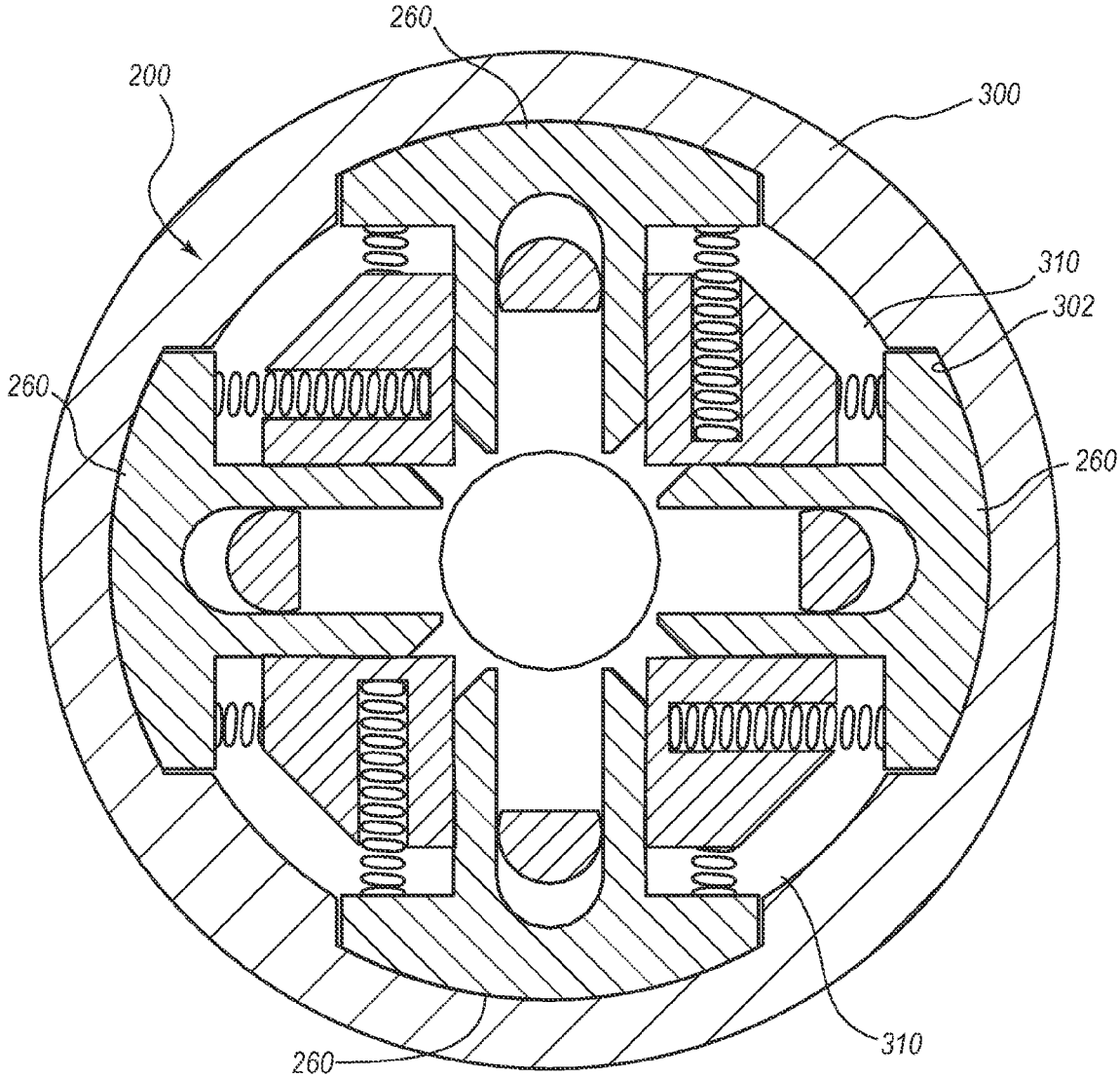
FIG. 3C illustrates an elevation view of the head assembly positioned in a casing.

Because of the axial movements of sonic drilling operations, the latches 260 may be secured against moving either up or down in casing 300. In some embodiments, drive keys 310 may be included in casing 300 to prevent rotation of head assembly 200 with respect to casing 300. In some embodiments, the drive key may be a portion of casing 300 extending into space between latches 260 FIG. 3C. The drive key may be a break in a surface feature 302, or may be a protrusion. Similarly, the drive key may be located in any position in the casing 300 to cooperate with any feature of the core barrel assembly to limit rotation of the core barrel assembly.

In some embodiments, a lock may be employed to prevent latches 260 from moving inwardly while in an extended position. For example, as shown in FIG. 3A, an extended portion 240A of the spearhead 240 may extend between latches 260 once each of the latches 260 is deployed; preventing the latches 260 from moving inwardly. Once the spearhead 240 is lifted, the latches 260 would then be able to move into a retracted position as described above.

In at least one example, the latches 260 may operate as a unitary member. For example, guide rails 242 may include a camming slot having a camming profile and latches 260 may have cam pins located in the slots such that as guide rails 242 move upward and downward, the cam pins would follow the camming profile, forcing latches 260 to move between extended and retracted positions. In other embodiments, latches 260 may be retracted and extended using other components and designs known to those of skill in the art.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Indeed, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A core barrel head assembly configured to engage with an outer casing, the core barrel head assembly having a longitudinal axis, comprising:

a body having an inner surface and a connector portion, the inner surface of the body defining a central channel and a receiving opening in communication with the central channel, the receiving opening being axially opposed from the connector portion, the connector portion configured for engagement with a core barrel assembly;

a spearhead having a frustoconical point, an opposed bit end, and an elongate shaft extending between the frustoconical point and the bit end, at least a portion of the elongate shaft of the spearhead being positioned within the central channel of the body, the frustoconical point of the spearhead being positioned external to the body and configured for engagement with a wireline assembly, the spearhead being operatively associated with said body and configured to translate axially relative to said body;

a spring operatively associated with said spearhead, the spring being positioned within the central channel of the body such that at least a portion of the elongate shaft of the spearhead is positioned within the spring, wherein said spring axially biases said spearhead toward the connector portion of said body along the longitudinal axis of the core barrel head assembly to oppose axial movement of the spearhead away from the connector portion of the body along the longitudinal axis; and at least two latches operatively associated with said spearhead and said body and being positioned proximate the receiving opening of the body, said at least two latches being configured to translate between an extended position and a retracted position relative to said body in response to axial translation of said spearhead relative to said body, wherein in an extended position, said at least two latches cover more than 25% of the circumference of said body adjacent said at least two latches;

wherein said at least two latches prevent the core barrel head assembly from moving axially upward and axially downward relative to the outer casing when in the extended position.

2. The assembly of claim 1, wherein the at least two latches comprises four latches operatively associated with the body and the spearhead.

3. The assembly of claim 2, wherein in the extended position said at least two latches cover at least 50% of the circumference of said body adjacent said at least two latches.

4. The assembly of claim 1, further comprising at least one guide rail coupled to the spearhead, said at least one guide rail having at least one cammed surface formed thereon; and at least one follower coupled to each latch of the at least two latches.

5. The assembly of claim 4, wherein said at least one follower is configured to move said at least two latches from the extended position while said at least one follower is in communication with said at least one cammed surface to the retracted position when said at least one follower is not in communication with said at least one cammed surface.

6. The assembly of claim 5, wherein the at least one guide rail translates axially to move the at least one cammed surface in and out of engagement with the at least one follower.

7. The assembly of claim 5, wherein each latch of the at least two latches has at least one guide rail operatively associated therewith, and wherein a cammed surface is formed on each guide rail of each respective latch.

8. The assembly of claim 7, further comprising at least one spring coupled to each latch of the at least two latches and configured to bias said at least one follower into engagement with said at least one guide rail of each respective latch.

9. The assembly of claim 8, wherein axial translation of said spearhead away from said body results in movement of said at least two latches to said retracted position.

10. A drilling assembly, comprising:

an outer casing extending about a longitudinal axis, the outer casing including a radially outward extending groove and a radially inward extending ridge; and a head assembly configured to be positioned within the outer casing, the head assembly including:

a body, a lip, a spearhead operatively associated with the body and configured to translate axially relative to the body, and a plurality of latches operatively associated with the spearhead and the body, the plurality of latches being configured to move between an extended position and a retracted position relative to the body in response to axial translation of the spearhead relative to the body, the plurality of latches including upper and lower surfaces extending perpendicular to the longitudinal axis, wherein when the plurality of latches are in an extended position and secured to the outer casing:

the upper and lower surfaces of the plurality of latches extend into the groove of the outer casing, the plurality of latches covers more than 25% of the circumference of the body adjacent the plurality of latches to secure the head assembly in place relative to the outer casing, the plurality of latches engage the outer casing and prevent the head assembly from moving axially upward and axially downward relative to the outer casing, and the lip is seated against the ridge.

11. The assembly of claim 10, further comprising a spring operatively associated with the spearhead, wherein the spring biases the spearhead toward the body.

12. The assembly of claim 10, wherein the lip is part of the body.

13. The assembly of claim 10, wherein the plurality of latches are adapted to translate into and out of the groove.

14. The assembly of claim 10, wherein gaps between edges of the groove and the upper and lower surfaces of the plurality of when the plurality of latches are extended into the surface feature are less than about 0.05 inches.

15. The assembly of claim 14, wherein the gaps are less than about 0.015 inches.

16. The assembly of claim 10, further comprising a drive key extending from the groove and wherein the drive key is configured to be received at least partially between adjacent latches to prevent rotation of the head assembly relative to the outer casing.

17. The assembly of claim 10, further comprising an overshot assembly configured to releasably engage the spearhead.

18. The assembly of claim 10, further comprising a core barrel coupled to the head assembly.

19. A drilling system, comprising:

an outer casing;

a sonic drill head configured to transmit vibratory forces to the outer casing; and a head assembly having a longitudinal axis and configured to be positioned within the outer casing, the head assembly comprising:

a body having an inner surface and a connector portion, the inner surface of the body defining a central channel and a receiving opening in communication with the central channel, the receiving opening being axially opposed from the connector portion, the connector portion configured for engagement with a core barrel assembly, a spearhead having a frustoconical point, an opposed bit end, and an elongate shaft extending between the frustoconical point and the bit end, at least a portion of the elongate shaft of the spearhead being positioned within the central channel of the body, the frustoconical point of the spearhead being positioned external to the body and configured for engagement with a wireline assembly, the spearhead being operatively associated with the body and configured to translate axially relative to the body, and a plurality of latches operatively associated with the spearhead and the body and being positioned proximate the receiving opening of the body, the latches being configured to move between an extended position and a retracted position relative to the body in response to axial translation of the spearhead relative to the body;

a spring operatively associated with the spearhead, the spring being positioned within the central channel of the body such that at least a portion of the elongate shaft of the spearhead is ositioned within the spring, wherein the spring axially biases the spearhead toward the connector portion of the body along the longitudinal axis of the head assembly to oppose axial movement of the spearhead away from the connector portion of the body along the longitudinal axis;

wherein in an extended position, the plurality of latches cover more than 25% of the circumference of the body adjacent the latches to secure the head assembly in place relative to the outer casing; and the plurality of latches engage the outer casing and prevent the head assembly from moving axially upward and axially downward relative to the outer casing when the outer casing is subjected to sonic vibratory forces by the sonic drill head.

20. The system of claim 19, further comprising a surface feature formed in the outer casing.

21. The system of claim 20, wherein the surface feature includes a groove formed in the outer casing, the groove being sized to receive the latches therein.

22. The system of claim 21, wherein gaps between edges of the surface feature and the plurality of latches when the plurality of latches are extended into the surface feature are less than about 0.05 inches.

23. The system of claim 21, wherein the surface feature further includes a drive key extending from the groove and wherein the drive key is configured to be received at least partially between adjacent latches to prevent rotation of the head assembly relative to the outer casing.

24. A method of drilling, comprising:

tripping a core barrel assembly into a casing until a lip of the core barrel assembly seats on a radially inward extending ridge of an outer casing, the outer casing extending along a longitudinal axis;

engaging a latching mechanism into a radially outwardly extending groove in the outer casing by translating a plurality of latches of the latching mechanism radially outward such that the core barrel assembly is secured to the outer casing axially, wherein the plurality of latches comprise upper and lower surfaces extending perpendicular to the longitudinal axis of the outer casing, wherein the plurality of latches engage the outer casing and prevent the head assembly from moving axially upward and axially downward relative to the outer casing, wherein when the plurality of latches engage the outer casing, the upper and lower surfaces of the plurality of latches extend into the groove of the outer casing, and wherein the plurality of latches of the latching mechanism occupy at least about 25% of the circumference of the core barrel assembly; and drilling using a sonic drilling process.

25. The method of as recited in claim 24, wherein the plurality of latches of the latching mechanism comprises a plurality of spring-biased latches configured to engage the inside of the casing.

26. The method as recited in claim 24, further comprising:

disengaging the latching mechanism with a wireline retrieval system; and retrieving the core barrel assembly using a wireline retrieval system, wherein the latching mechanism is disengaged from the outer casing by a force applied to the core barrel assembly by the wireline retrieval system.

27. The method as recited in claim 24, wherein disengaging the latching mechanism includes sliding a bar member such that the plurality of latches are retracted into the core barrel assembly.

28. The method as recited in claim 24, wherein engaging the latching mechanism includes allowing the latching mechanism to engage the plurality of latches independently using spring force.

29. The method as recited in claim 24, wherein the plurality of latches of the latching mechanism occupy more than about 50% of the circumference of the core barrel assembly.

30. A head assembly, comprising:

a body;

a spearhead operatively associated with the body and configured to translate axially relative to the body;

at least two latches operatively associated with the spearhead and the body, the at least two latches being configured to move between an extended position and a retracted position relative to the body in response to axial translation of the spearhead relative to the body, wherein in an extended position, the at least two latches cover more than 25% of the circumference of the body adjacent the latches;

at least one guide rail coupled to the spearhead, the guide rail having at least one cammed surface formed thereon; and at least one follower coupled to each latch of the at least two latches;

wherein each follower is configured to move a latch from the extended position while each follower is in communication with the cammed surface to the retracted position when each follower is not in communication with the cammed surface.

* * * * *